US007244175B2

(12) United States Patent
Adams et al.

(10) Patent No.: US 7,244,175 B2
(45) Date of Patent: Jul. 17, 2007

(54) COIN RECYCLING MACHINE AND METHOD

(75) Inventors: Thomas P. Adams, Oconomowoc, WI (US); Robert L. Zwieg, Watertown, WI (US)

(73) Assignee: De La Rue Cash Systems Inc., Watertown, WI (US)

( * ) Notice: Subject to any disclaimer, the term of this patent is extended or adjusted under 35 U.S.C. 154(b) by 494 days.

(21) Appl. No.: 10/638,612

(22) Filed: Aug. 11, 2003

(65) Prior Publication Data

US 2004/0040820 A1 Mar. 4, 2004

Related U.S. Application Data

(60) Provisional application No. 60/407,437, filed on Aug. 29, 2002.

(51) Int. Cl.
*G07D 3/00* (2006.01)

(52) U.S. Cl. ..... 453/6; 453/10; 453/49; 453/57; 453/58; 453/61; 453/2

(58) Field of Classification Search ..... 453/6, 453/10, 12, 13, 33–35, 49, 57–62, 16, 17; 53/212, 213, 219, 531, 532; 232/55–61, 232/64–66

See application file for complete search history.

(56) References Cited

U.S. PATENT DOCUMENTS 3,590,833 A * 7/1971 Walton ..... 453/9
5,295,899 A * 3/1994 Adams et al. ..... 453/10
5,429,222 A * 7/1995 Delay ..... 194/343
5,492,212 A * 2/1996 Fillod et al. ..... 194/202
6,540,602 B2 * 4/2003 Adams et al. ..... 453/40
6,685,551 B2 * 2/2004 Adams et al. ..... 453/24
6,712,688 B2 * 3/2004 McGinty et al. ..... 453/57

* cited by examiner

*Primary Examiner*—Patrick Mackey
*Assistant Examiner*—Jeffrey A. Shapiro
(74) *Attorney, Agent, or Firm*—Quarles & Brady LLP

(57) ABSTRACT

A coin recycling machine (10) for receiving, sorting and dispensing coins, comprising a coin dispenser having a rotatable coin magazine (23) for holding respective denominations of coins and having an electronic control (100, 107), said electronic control (100, 107) being operable in response to a commanded total to control position of said coin magazine (23) to selectively dispense coins to provide the commanded total, a queuing device (52) for receiving the coins and arranging the coins in a queue, the queuing device (52) having an exit (66) directed towards said coin magazine (23) and having associated sensors (65, 72) for identifying a denomination of a next coin to pass through the exit (66) and the electronic control being responsive to the sensors (65, 72) associated with the queuing device for positioning the coin magazine such that coins are sorted into the coin magazine (23) by denomination as the coins exit the queuing device (52).

19 Claims, 9 Drawing Sheets

COIN RECYCLING MACHINE AND METHOD

CROSS-REFERENCE TO RELATED APPLICATION

The benefit of priority is claimed for this application based on U.S. Provisional Appl. No. 60/407,437, filed Aug. 29, 2002.

BACKGROUND OF THE INVENTION

The invention relates to coin dispensers, and in particular to coin dispensers of the type for dispensing change. Such coin change dispensers are found, for example, at cashier checkout locations and ticket booths and many other places.

Perhaps the best known type of coin change dispenser has an in-line configuration in which a plurality of generally upright coin holding tubes are aligned in a row. Examples of such coin change dispensers are shown, for example, in Walton, U.S. Pat. No. 3,590,833 and Duplessy, U.S. Pat. No. 4,593,709.

Such dispensers are assembled from numerous small, mechanical parts requiring many machining operations during manufacture, especially the parts of the coin ejector mechanisms. A coin dispenser having nine coin tubes would typically provide nine coin ejector mechanisms and each of these would include many small parts.

An additional problem in the art is the need to replenish the dispenser during the work shift. This requires reloading coinage and performing cash settlement operations in a back room to account for the coinage being dispensed and the coinage being received at a cash register.

Several patent documents have disclosed machines to receive, sort and dispense coins. In a published European patent application EP 0 137 637 published Apr. 17, 1985, coins are sorted into four tubes, from which coins may be dispensed. Generally, this is a large apparatus, resembling the in-line coin dispensers described above, and further having a ramp of complex design and many additional mechanical parts. Four tubes are disclosed for sorting and dispensing of more than four denominations. To handle additional denominations, more coin tubes and still more internal parts would have to be included.

On the other hand, there are some lightweight devices which combine sorting and dispensing as disclosed in U.S. Pat. No. 5,106,337 and U.S. Des. Pat. No. 324,600. It appears that these devices would not handle the full coin set of any country without being enlarged. It is not clear that they would work well with a larger number of coin tubes or withstand heavy commercial use.

There is a need for a coin recycling dispenser that would receive, sort and dispense coins for a full coin set in busy cash handling locations. For global marketability, such a machine should be adaptable to the coin sets of many countries. Such a unit should have a relatively simple construction, and provide a lower manufacturing cost, and also be relatively compact in size.

SUMMARY OF THE INVENTION

The invention provides a coin recycling machine and method for receiving, sorting and dispensing coins for a plurality of denominations.

The coin recycling comprises a coin dispenser having a rotatable coin magazine for holding respective denominations of coins and having an electronic control that is operable in response to a commanded total to control position of the coin magazine to selectively dispense coins to provide the commanded total. A queuing device is provided for receiving the coins and arranging the coins in a single file. The queuing device has an exit directed towards the coin magazine and associated sensors are provided for identifying a denomination of a next coin to pass through the exit. The electronic control is responsive to the sensors associated with the queuing device for positioning the coin magazine such that coins are sorted into the coin magazine by denomination as the coins exit the queuing device. From there, the coins are dispensed from the coin magazine in a dispensing operation.

A general object of the invention is to provide a compact machine for recycling coins received from customers, so that they can be dispensed as change. This reduces the amount of time that cashiers or other employees need to perform cash settlement transactions in a back room, where new coins are received and monies are accounted for. As in other recycling operations, maximum efficiency is realized by better utilizing the cash resources available.

Another object of the invention is to provide a sorting device which can be assembled with an electronic rotary coin dispenser. In this combination, coins are sorted into a coin magazine from which they are also dispensed.

Another object of the invention is provide a minimum number of parts, thereby reducing costs when the dispenser is manufactured in significant volume.

One advantage of the invention is that it is easily adaptable to different national coin sets and to different change capacities, such as 0.99 and 4.99. One coin recycling machine could be used with different magazines, including magazines with coins from different countries. The machine is operable with different magazines through programmable electronic control.

The coin recycling dispenser of the invention can be used in many applications. For example, the coin dispenser can be used to dispense change at the checkout counter of a grocery store or a convenience store, or at the cashier of a restaurant. The coin dispenser can be provided as part of a system that provides change in exchange for paper currency, or it can be provided in tandem with a currency dispenser, for example, as part of an ATM. It also could be part of a point-of-sale terminal.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention.

DETAILED DESCRIPTION OF PREFERRED EMBODIMENTS

Figure 1:
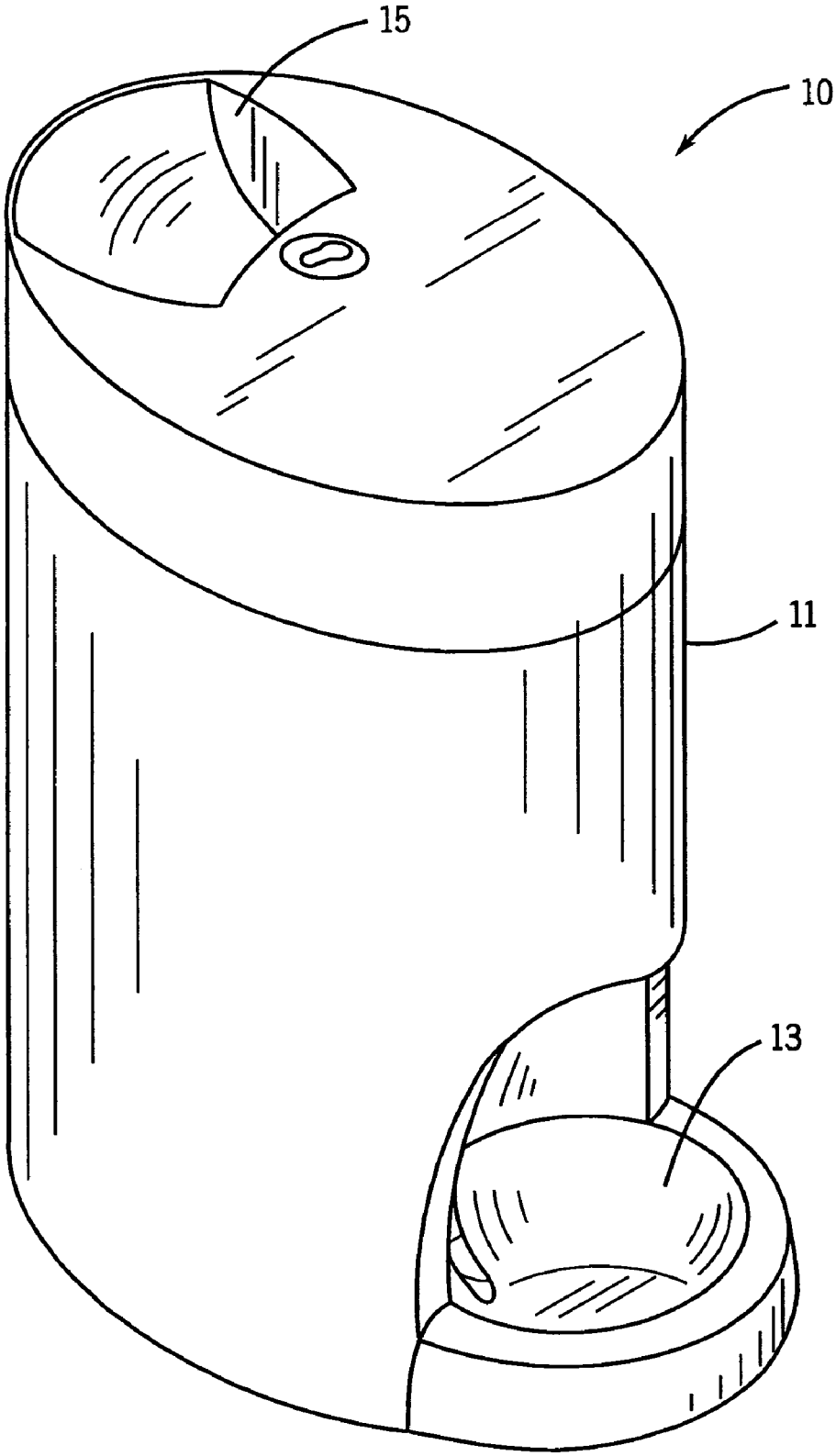
FIG. 1 is a perspective view of a coin recycling machine according to one embodiment of the invention.
Figure 2:
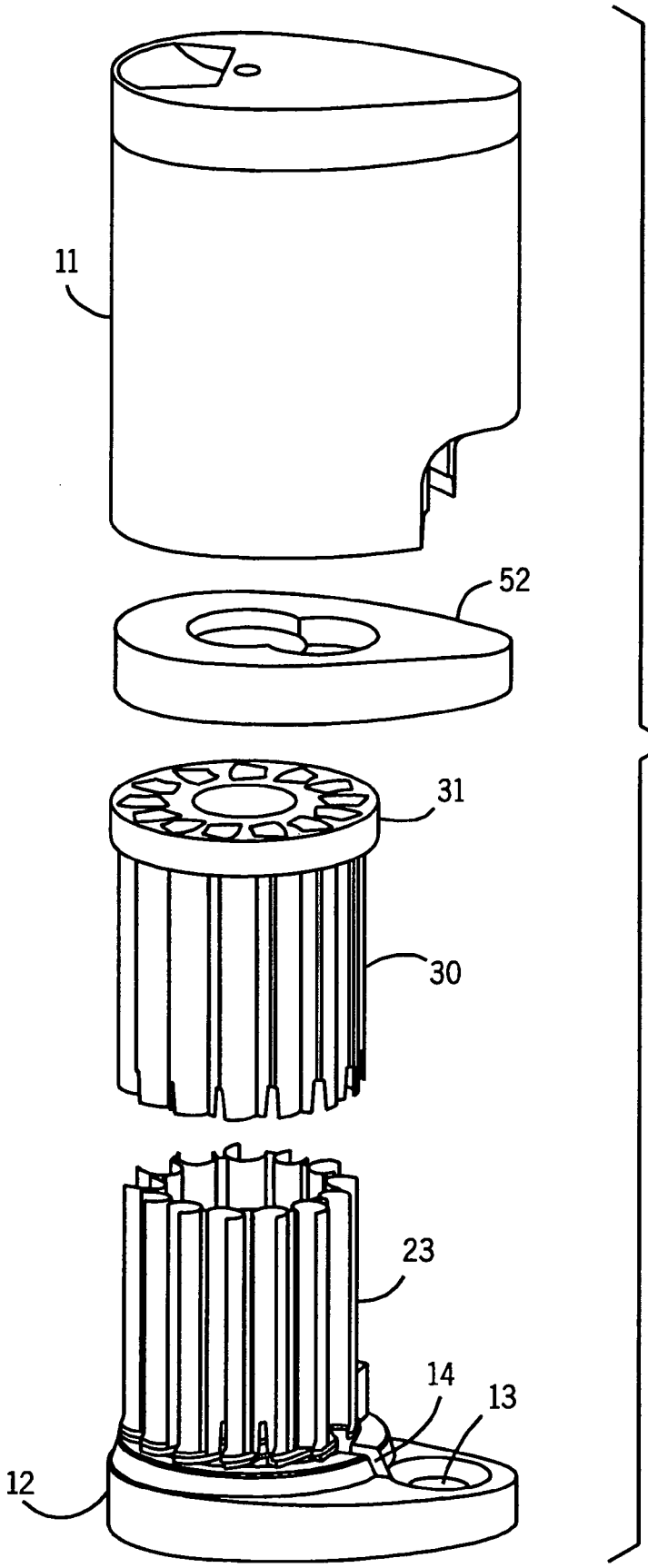
FIG. 2 is an exploded side view in elevation of the coin recycling machine of FIG. 1 with the cover removed.

A preferred embodiment of a coin recycling machine 10 according to the present invention is illustrated in FIGS. 1-8*b*. As shown in FIGS. 1 and 2, the coin recycling machine 10 includes an outer, generally cylindrical cover 11 that is attached to a base 12. The cover 11 can be opaque or transparent or can include a transparent part. The cover 11 can be locked to the base 12 to prevent access to the interior of the coin dispenser 10. The base 12 is a molded plastic part with an integrally molded coin cup 13 and a coin dispensing channel 14 leading into the coin cup 13. As an alternative, the cup 13 can be provided as a separate piece and mounted to the base 12 or other types of coin chutes or ramps can be used to transfer coins to a receptacle or device. A hopper 15 is provided in the top of the cover 11 for accepting coins into the machine 10.

FIG. 2 shows an exploded view of the internal parts of the machine 10 with the cover 11 removed. The upper assembly is a queuing device 52. The middle assembly is a coin magazine assembly cover 30 and manifold 31. And, the lower assembly is an assembly of the coin magazine 23 and the base 12.

Figure 3:
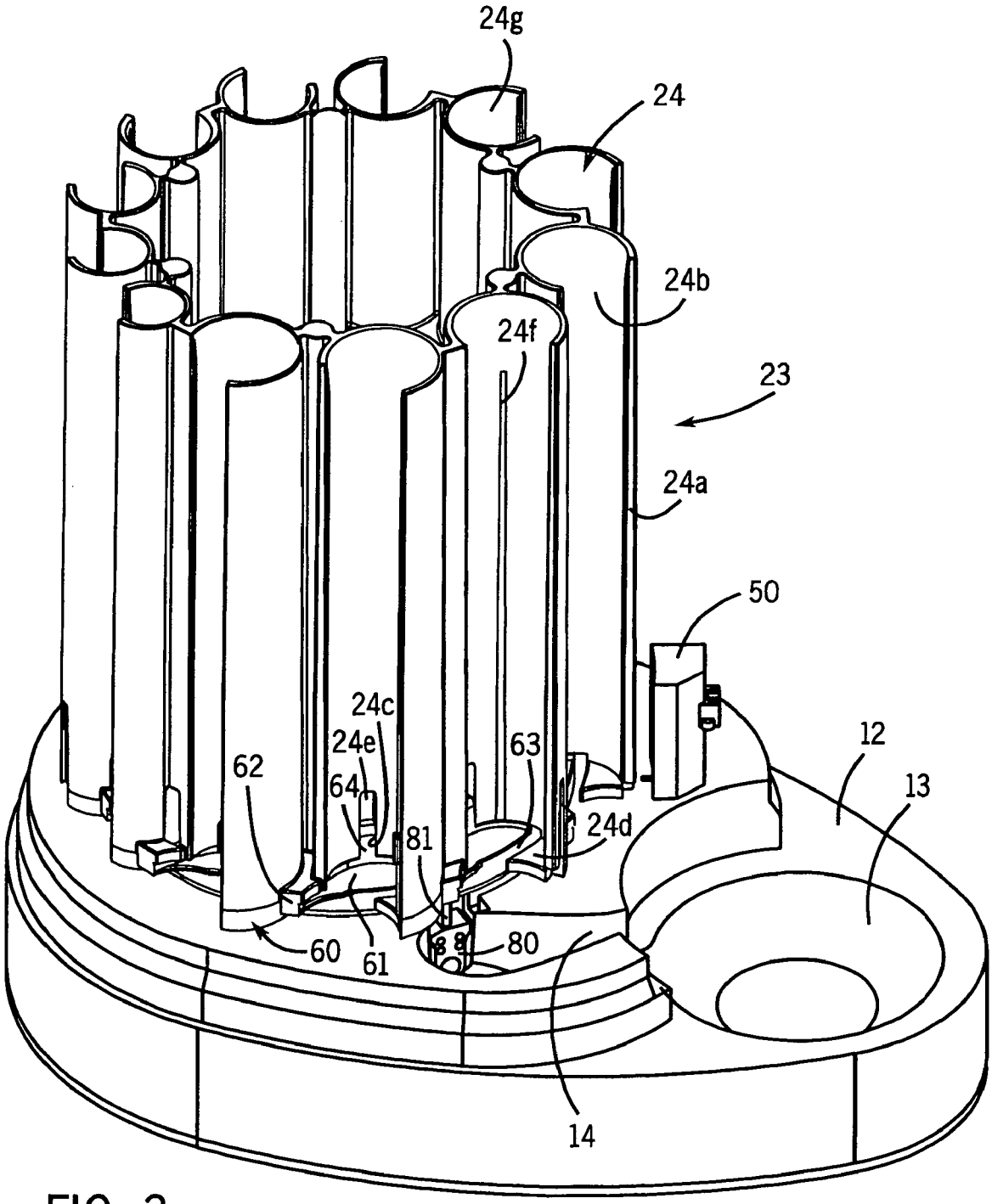
FIG. 3 is a perspective view of a coin dispensing portion of the coin recycling machine seen in FIGS. 1 and 2.
Figure 4:
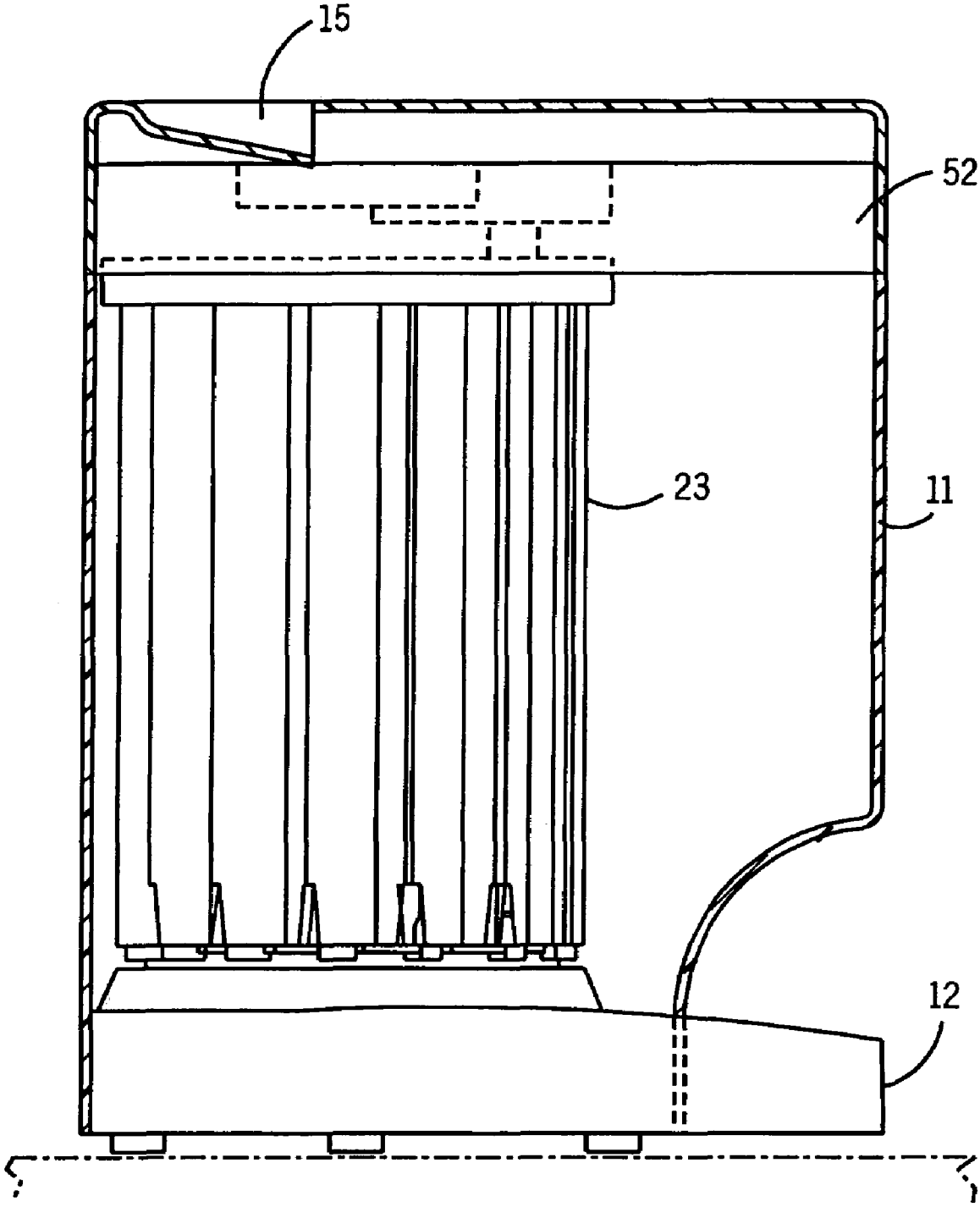
FIG. 4 is a side view in elevation of the machine seen in FIGS. 1 and 2.

As seen in FIG. 3, the coin magazine 23 is formed with a plurality of upstanding coin channels 24, in this example, numbering twelve. As seen in FIG. 1, the coin channels 24 are empty, to allow a view of the underlying structure, however, in use, these channels 24 would hold stacks of coins, each channel 24 being dedicated to a corresponding denomination. It may be also be advantageous to have more than one stack coins for certain denominations, such as dimes for example, in making 0.99 change for one U.S. dollar.

The coin magazine 23 is mounted on a base 12 for rotation in a counterclockwise direction. As it rotates to move the coins along a circular coin path, a single coin ejector 80 is repeatedly operated to eject coins from the bottom of the coin channels 24 into the coin dispensing channel 14 and then into a cup 13.

For details of the assembly of the coin magazine 23 to a base member 60, and the operation of the coin magazine 23 and coin ejector 80 to dispense coins from the coin magazine 23 in response to a commanded total, reference is made to Adams et al., U.S. patent application Ser. No. 09/994,415, filed Nov. 27, 2001, and entitled "Electronically-Controlled Rotary Coin Change Dispenser," the specification of which is hereby incorporated by reference.

As seen in FIG. 3, the coin magazine 23 is assembled with a ring-shaped magazine base member 60. Both components are integrally molded from a high durability plastic material or can be made of metal. The coin magazine 23 is generally cylindrical in shape and forms a plurality of longitudinally extending coin-holding channels 24 around its periphery, with coin exit openings 24*b* through its outer surface. Each channel 24 has a sidewall 24*a* seen in a C-shape in cross section with an opening 24*b* in the channel sidewall 24*a* facing to the outside of the magazine 23. The diameter of each channel 24 varies according to the denomination of coins it will hold. The channel openings 24*b* face in a rearward-looking direction in relation to the counterclockwise direction of rotation of the magazine 23.

The coin magazine 23 is formed with channels having a taper of not greater than 0.2 degrees, having a plurality of circumferentially spaced, zero taper ribs 24*f* (FIG. 3) running up inner sidewall surfaces 24*a* of the channels 24 for securely holding the coins, with the ribs 24*f* terminating a spaced distance from a top opening of the channels 24 to provide a slightly angled funnel 24*g* to allow for easier loading of coins. Normally, in molding a part such as the magazine 23, the walls 24*a* of the channels 24 would be provided with some taper for molding purposes. That has been minimized in this construction.

Figure 7:
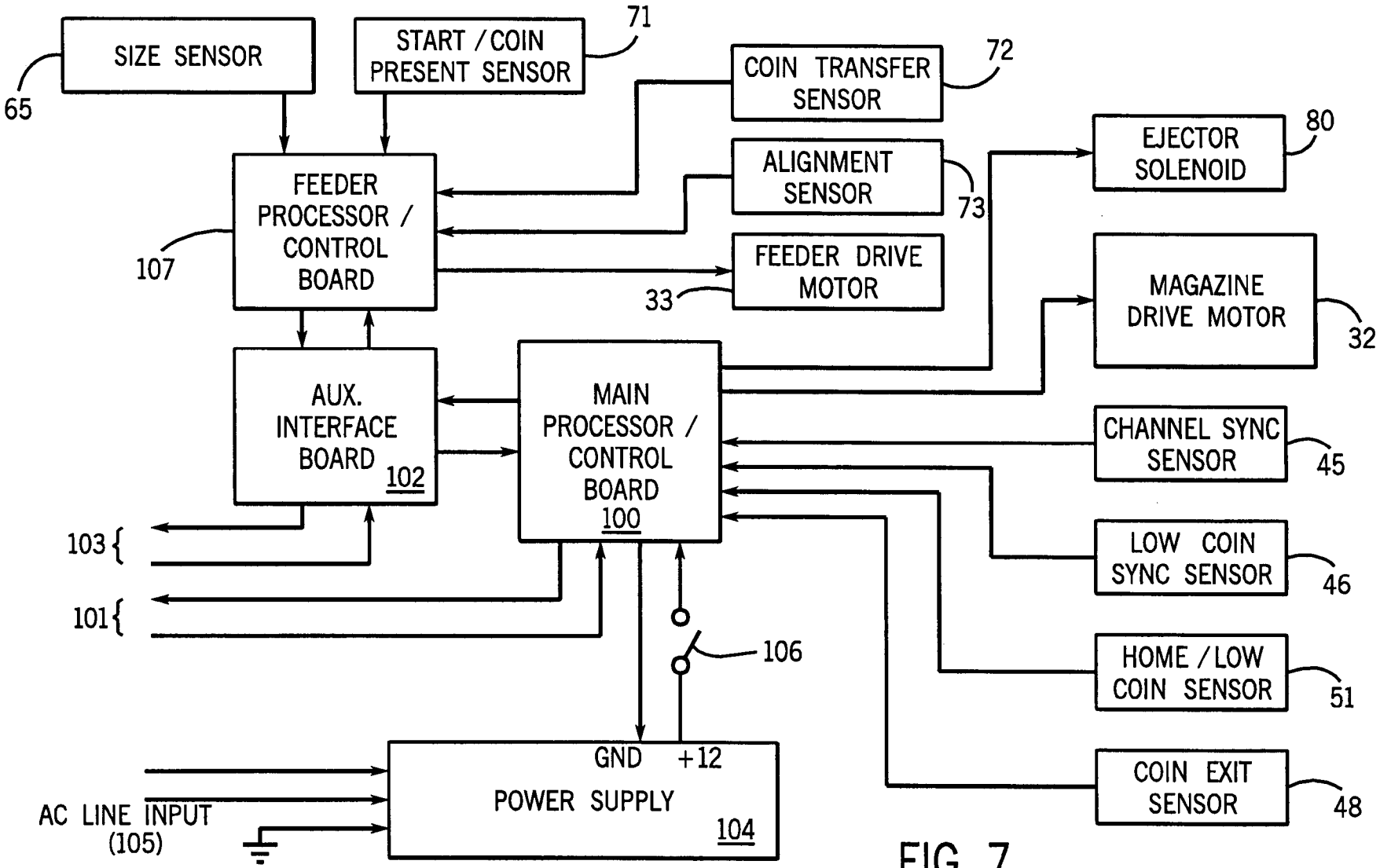
FIG. 7 is a block diagram of the electronic control included in the machine of FIGS. 1-6.

On the bottom of the base member 60 are markers (not seen) corresponding to the respective channels 24. These markers are of slightly differing length according to the diameter of their corresponding channel 24. The markers are displaced by an angle in advance of their corresponding channels 24 so as to be sensed by the position sensors 45, 46 (represented schematically in FIG. 7) in advance of the channel 24 reaching either the coin ejector 80 or the home/low coin sensing station 50 (FIGS. 3, 7). The channel sync sensor 45 that cooperates with coin ejector 80 is positioned eighteen degrees in advance of the ejector 80 (FIG. 3). The low coin sync sensor 46 that cooperates with a low coin sensor 51 in the home station 50 is positioned ten degrees in advance of the home station 50. This means that the marker for the first channel is angularly displaced from the first channel approximately ten degrees so as not to encounter the sensors 45, 46 before the first channel is opposite either the beginning of the ejector 80 or opposite the low coin sensing/home station 50.

The base member 60 also includes square posts 64 (FIG. 3) that project upward from a top of the member 60 to be received in the slots 24*c* in the channel sidewalls 24*a* to be described. When the magazine base 60 is assembled to the magazine 23, the square posts 64 fit into the slots 24*c* in the magazine 23 to locate the magazine base member 60 at the proper rotational position in relation to the magazine 23. Bolts (not shown) are inserted through the magazine base 60 into the magazine 23.

The magazine base member 60 forms partial floors 61 for each channel 24 which are separated by barrier projections 62. When assembled with the magazine 23 (FIG. 3), this member 60 forms an arcuate slot 63 for each channel 24 for receiving a pin 81 of a coin ejector 80. The slots 63 are formed along a circular coin path followed by the stacks of coins as the magazine 23 is rotated.

The magazine 23 also forms the upright slots 24*c* that are located a short distance above the floors 24*d* in the bottom of each channel 24. These slots 24*c* receive the posts 64 of the base member 60, but have an open portion above that which forms a window 24*e* (FIG. 3) for marking a low level of coins. A signal is transmitted through such a window 24*e* when the channel 24 is opposite the home station 50. The home station 50 houses an emitter for the home/low coin sync sensor 51 represented schematically in FIG. 7. If the signal (logic "1") is detected by the home station detector (positioned within the magazine 23) when a channel 24 has its window 24*e* aligned with the home station 50, it means that the coin level is low, because it means the signal path is unobstructed by coins in the channel 24. The use of one sensor 51 for both low coin and home position functions allows verification of the circuitry during each dispense cycle.

The ejector 80 is a single mechanism located at a single location along the circular coin path. The actuation of a solenoid (not shown) will cause a pin 81 to move vertically upward through slot 63 (FIG. 3) such that it will contact the edge surface of the lowermost coin in that receptacle 24. The pin 81 engages the coin at a point approximately midway between the opposite portions of the sidewall 24*a* of the channel 24. This will push the coin out of the channel 24, through the dispensing channel 14 and into the change cup 13. The solenoid is then de-energized and the force provided by a return spring will move the pin 81 vertically downward to its starting position. If the pin 81 does not fully retract, the pin 81 will be urged downward by a bottom surface of the magazine 23. The pin 81 will not engage the lowermost coin in a next channel unless the solenoid 82 is energized again. The coin ejection pin 81 moves linearly in a direction substantially parallel to the (vertical) rotation axis of the magazine 23 between an extended position and a retracted position.

Figure 5:
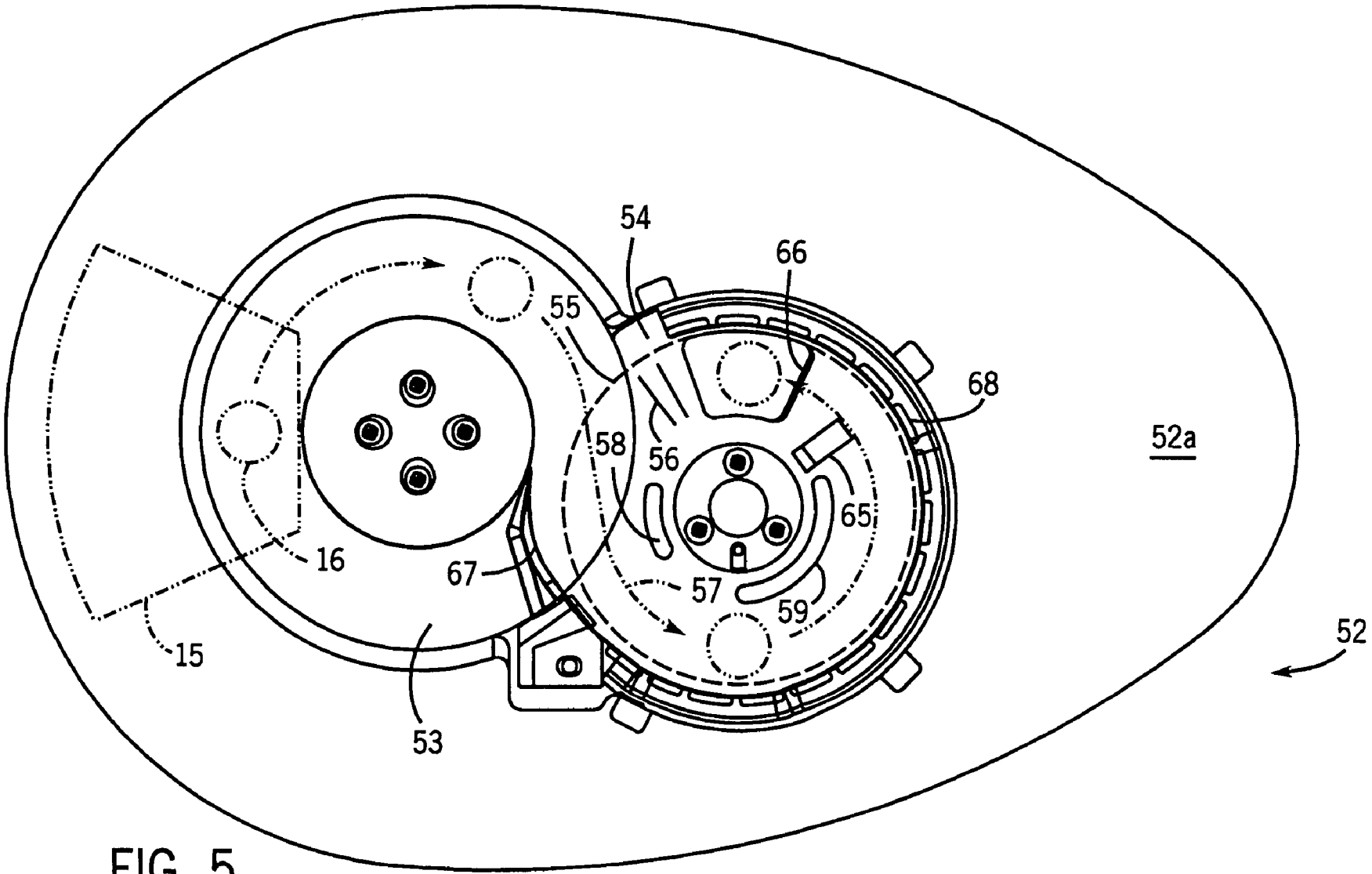
FIG. 5 is a top plan view of the coin queuing subassembly of the machine of FIGS. 1, 2 and 4.
Figure 6:
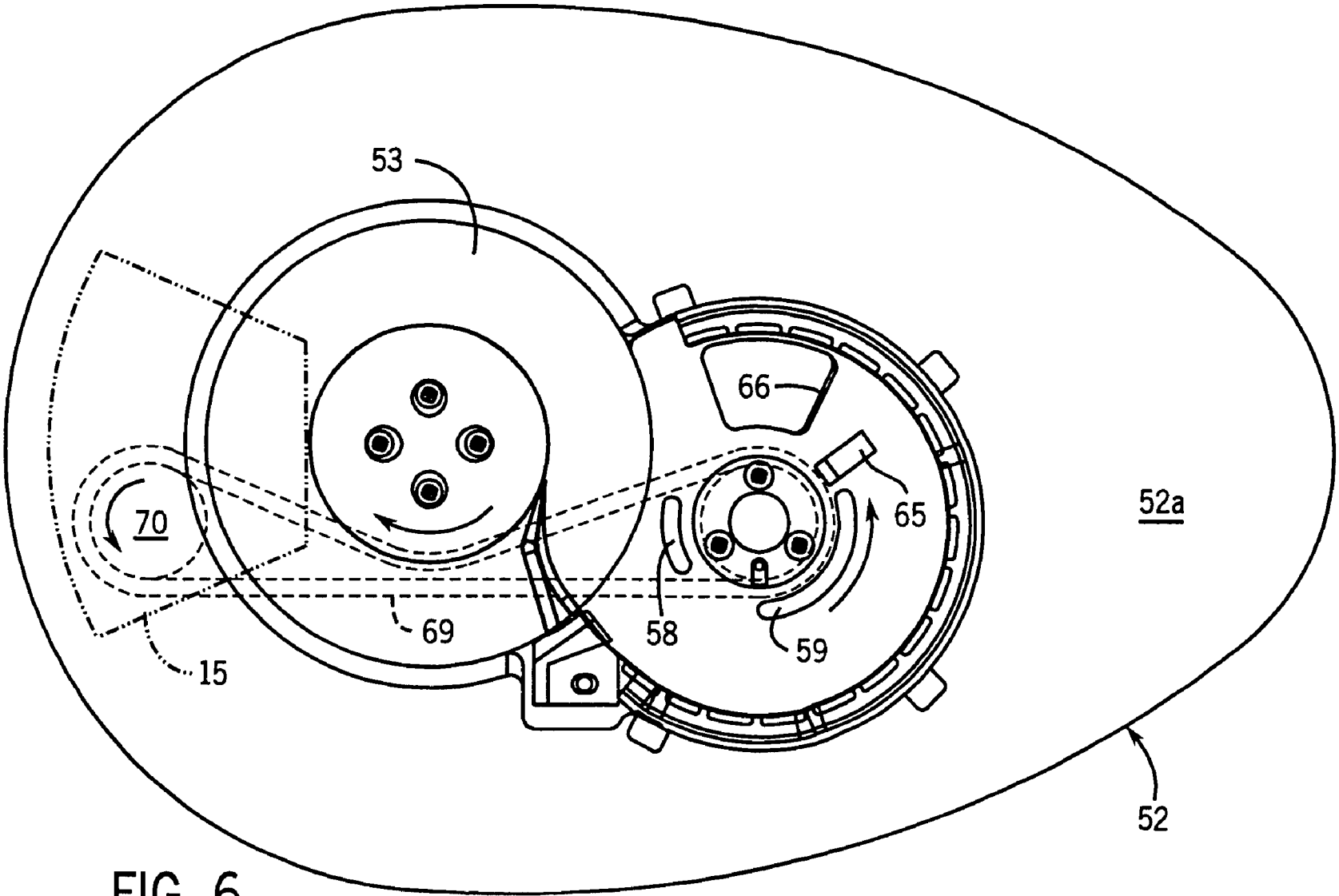
FIG. 6 is a second top plan view of the queuing assembly of FIG. 5 with parts shown in phantom.

FIGS. 5 and 6 show a top plan view of a queuing device 52. This device 52 includes a body 52*a* and a first rotatable disc 53 mounted in the body 52*a* for receiving coins 16 from the hopper 15. Coins 16 follow a coin path 57 in a clockwise direction until reaching a point at which an overlapping drive disc 55 with radial fingers 56 pushes the coin onto a stationary exit member 54 also mounted in the body 52*a*, where the coin path 57 continues in a counterclockwise direction. A coin point 67 is provided over the first disc 53. This tends to separate stacked coins and allow only one layer of coins to move around the disc 53 so that a single file or queue is formed where the coins 16 are picked up by drive member 55.

The exit member 54 has an exit aperture 66 at about 9 o'clock as seen in FIGS. 5 and 6. The coins 16 proceed around the exit member 54, passing over a coin size sensor 65 and then passing through the exit aperture 66. The coins are contained on the exit member by protruding arcuate ridges 58, 59. Slots 68 receive tabs on a rim which is flexed to curve around the outside edge of the exit member 54, where it provides an outside reference edge for coins traveling around the member 54. Size sensor 65 measures the diameter of the coin from the smallest to the largest, and is offset from the reference edge by a distance less than the diameter of the smallest anticipated coin to be measured for size. The size sensor 65 is typically a linear array of optical elements which sense the coin by sensing shadow from the coin passing over it. Within the exit aperture 66 is a coin transfer sensor 72 represented schematically in FIG. 7. As seen in FIG. 6, both discs 53 and 55 are driven by a common belt 69 which transfers power from the feeder drive motor 33, which is coupled to a shaft driving the drive disc 55. A pulley 70 is provided at the other end of the belt 69 for supporting the belt 69.

The feed drive motor 33 (FIG. 7) is started when coins are sensed on the first disc 53 through the coin present sensor 71 (FIG. 7). The feed drive motor 33 moves the coins a distance along coin path 57 until coin size is measured at size sensor 65. The feed drive motor 33 will then be stopped and some checks performed (including positioning the coin magazine, if necessary) before causing the coin to be pushed through aperture 66, where its passage is sensed for counting purposes by a coin transfer sensor 72 (FIG. 7).

It can be further seen that the queuing device 52 moves the coins along a path disposed above the coin magazine 23 and disposed substantially parallel to a supporting surface for the coin recycling machine 10. The coins are moved along a path substantially perpendicular to the axis of rotation for the coin magazine 23.

FIG. 7 shows the electronic controls for the dispenser 10. A main processor and control circuit board 100 (FIG. 7) is mounted in the base 12 of the machine 10 seen in FIGS. 1 and 2 and is connected to an RS-232 communication cable 101. Also mounted in the base 12 is an auxiliary interface circuit board 102, which is connected to an auxiliary interface cable 103. The auxiliary interface circuit board 102 provides alternative and enhanced capabilities to the electronic system to increase the machine versatility. It is a plug-in "daughter board" to the main processor and control circuit board 100. It can incorporate a flash memory for firmware program changes.

A power supply 104 (FIG. 7) is provided in a package similar to a battery-charging adapter for a notebook computer. The power supply 104 receives 120-volt AC power through a power cord 105 and supplies 12-volt DC power to the main processor board through a cover interlock switch 106. When the cover 11 is open, the interlock switch 106 is open to disconnect power to the coin recycling machine 10.

The main processor board 100 connects to the ejector solenoid 80, to the magazine drive motor 32, to a "channel sync" position sensor 45 for synchronizing the position of a selected channel to the coin ejector 80, a "low coin sync" position sensor 46 for synchronizing the position of a selected channel to the home position/low coin sensor 51, which is also connected to the main processor board 100, and to the coin exit sensor 48.

Whenever AC input power is applied to the 12-volt DC power supply 104 or whenever the cover 11 is closed to lock the cover interlock switch 106, twelve DC volts are supplied to the main processor board 100. As a result the main processor executes an initialization routine to rotate the magazine 23 to the home position, stopping after a predetermined delay following detection of the home position and loading memory locations on the main processor board 100 with values representing magazine coin channels 24 with full stacks of coins. The delay is determined so as to ensure that the magazine 23 stops in a position that will allow it to be accelerated to the operational speed just prior to reaching the "home" position during an actual dispense cycle. This position is defined as the "pre-accelerate" position.

Also seen in FIG. 7 is the feeder processor board 107 and sensors 65, 71, 72 and 73. The functions of sensors 65, 71 and 72 were explained previously. The alignment sensor 73 senses alignment of the exit aperture 66 with a particular channel 24 of the coin magazine 23.

Figure 8A:
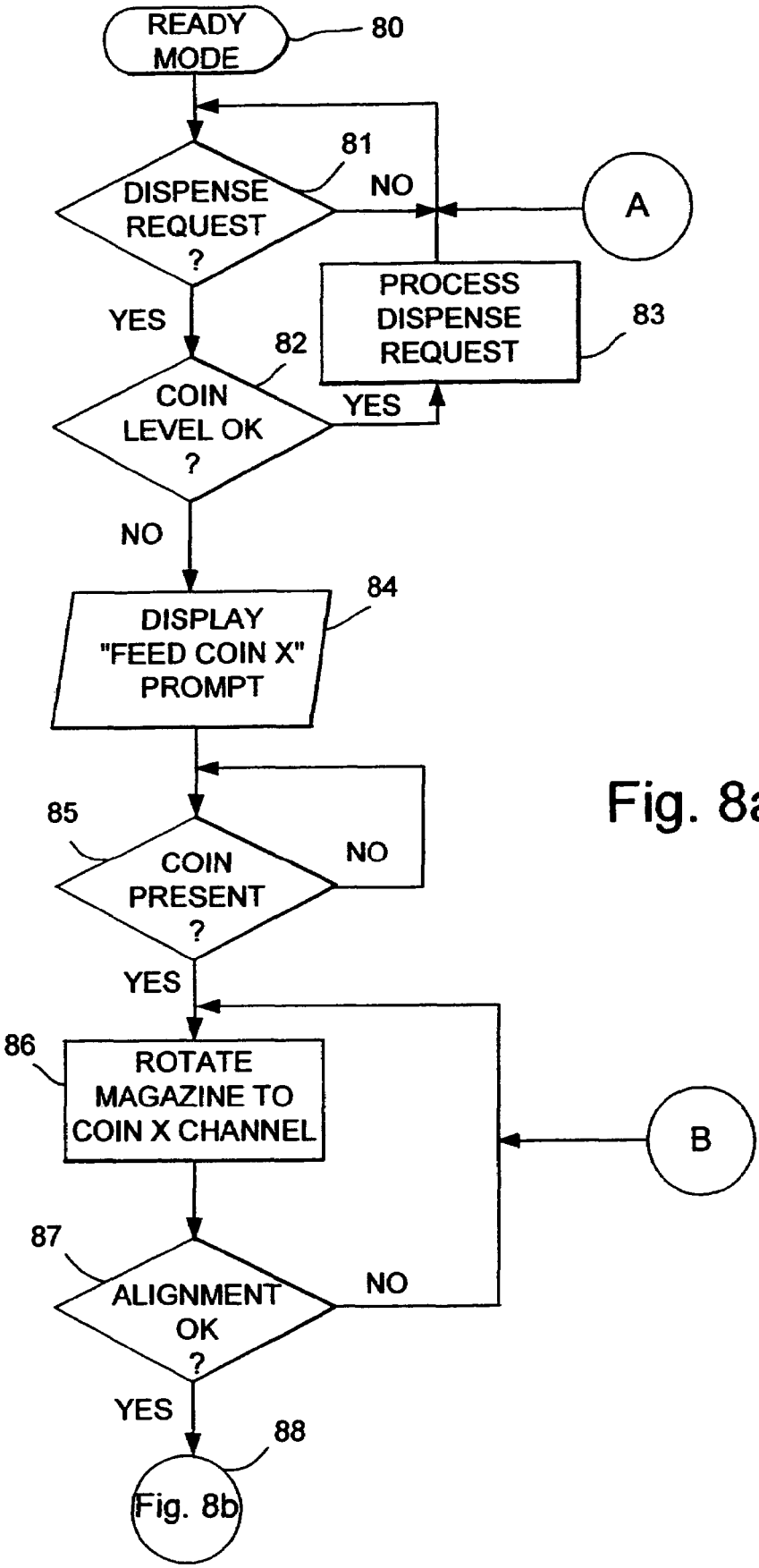
FIGS. 8*a* and 8*b* are flow charts of the operation of the coin recycling machine of FIGS. 1-7.
Figure 8B:
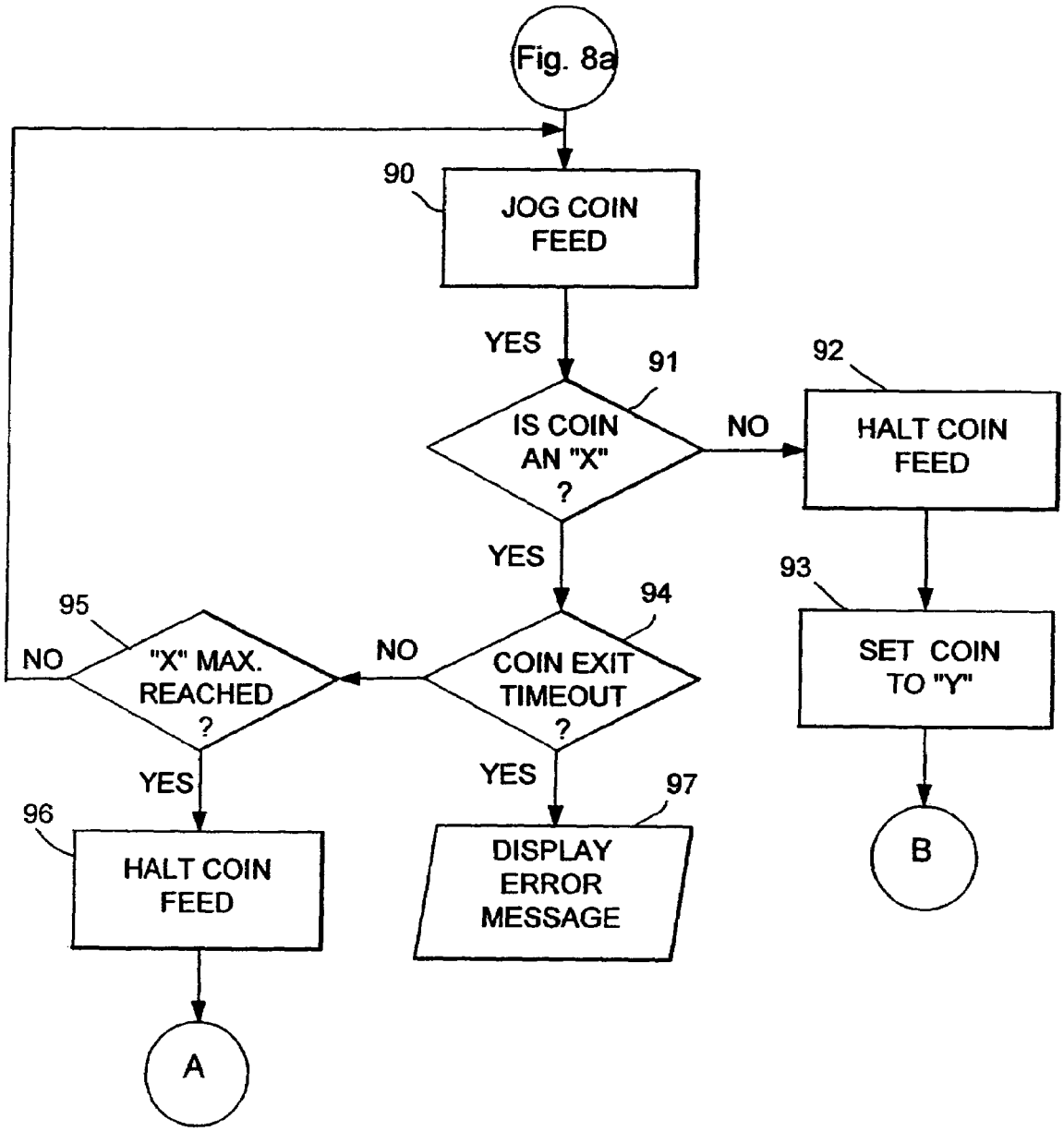

As seen in FIGS. 8*a* and 8*b*, which provide flow charts of the operation of the machine 10 under the control of the main processor board 100, after power-up, the machine 10 will be initialized and then enter a ready mode for processing coin as represented by start block 80. The main processor will test for a dispense request (a commanded total) as represented by decision block 81. In the event there is no such request, as represented by the "NO" branch from decision block 81, it will loop back and test again on a periodic basis.

Assuming that a dispense request (a commanded total) is received, as represented by the "YES" result, then the processor will test for sufficient coin levels to provide the total amount of coin requested as represented by decision block 82. If the coin level is suitable, as represented by the "YES" result, then the processor will process the dispense request by operating the dispenser as described in U.S. patent application Ser. No. 09/994,415, cited above, as represented by process block 83. If the coin level is insufficient, as represented by the "NO" result from decision block 82, then the processor will cause a prompt to be displayed to the user to feed sufficient coins of a denomination "X" into the hopper 15 seen in FIG. 1. The processor will then sense through the coin present sensor 71 that the coins have been fed into the machine, by checking the sensor 71 as represented by decision block 85. Where a new coin of the identified denomination "X" is detected by the coin size sensor 65, the main processor will execute program instructions to energize the motor 32 and rotate the coin magazine 23 so that the coin channel for denomination "X" is aligned with the coin exit 66 from the exit member 54. After each power movement, a check is made for proper alignment of the coin channel by using the alignment sensor 73, and this is represented by decision block 87. If the alignment is satisfactory the routine proceeds to the rest of the programmed routine in FIG. 8*b*. If the alignment is sensed as misaligned, as represented by the "NO" result from decision block 87, then the processor performs another movement of the coin magazine 23 by looping back to execute block 86 again.

After the coin magazine is positioned to accept a coin of denomination "X," the feed motor 33 driving the rotating disc 55 is energized to jog (move in an increment) the coin 16 around the coin track 57 until it is sensed by the size sensor 65, as represented by process block 90.

If the coin is sensed as not being a coin of denomination "X," but of denomination "Y," in decision block 91, the coin feed operation is halted as represented by process block 92 and the identity of the coin being processed is changed to denomination "Y," as represented by decision block 93. The routine then returns to connection point "B" in FIG. 8*a* to position the coin magazine to accept a coin of denomination "Y".

If the coin is sensed as being a coin of denomination "X," in decision block 91, there is a further test to see if it has dropped through the coin exit aperture 66 within a timeout period, as represented by decision block 94. If the coin was sensed by coin size sensor 65, but is not sensed at the coin exit aperture 66 by a coin transfer sensor 72, as represented by the "NO" result from decision block 94, there has been a misfeed or some other error. In that event, an error message is displayed on the display of the control for the machine 10, as represented by output block 97.

Assuming that the coin is sensed by the coin transfer sensor 72 within the timeout period as represented by the "NO" result from decision block 94, then a test is made to see if a maximum limit for a denomination "X" has been reached. In the event that the maximum limit has not been reached, the routine will loop back to look at the next coin to see if it is of denomination "X." If a limit has been reached, the coin feeding is halted, and the routine returns to the "A" connection point in FIG. 8*a* to look for a dispense request and test the coin supply.

From this description it can be seen how the coin magazine 23 is first positioned to accept coins of a particular denomination, and then the queuing device is jogged and each coin sensed to verify that is of the denomination for which the coin magazine 23 has been positioned. This arrangement makes a ramp unnecessary in the preferred embodiment, thereby saving cost and complexity, however, a ramp could be added in other embodiments without departing from the full scope of the invention.

The mix of coins contained in the magazine 23 is such that one complete dispensing rotation can provide up to 99 cents (or $4.99) in change. According to one preferred embodiment, the magazine assembly 22 is rotated at 30 RPM. If the change is dispensed in one revolution, this occurs in a time period of two seconds. Where necessary, the magazine 23 can be rotated through a second revolution to complete the dispensing of the requested amount of change. The magazine does not need to stop in order to complete a dispense cycle. If coins from multiple channels 24 in more than once revolution must be ejected to complete the payment of change, the motor 31 can be driven until payment is made and then index to the pre-accelerate position once again.

The dispenser 20 can be used with a variety of different magazines 23 containing different mixes of coins. For example, one magazine 23 could have coin channels with different sizes (diameters) to hold a mix of coins (pennies, nickels, dimes, quarters, dollar coins), while another magazine 23 could have coin channels with equal sizes (e.g., all holding quarters or tokens, which would be useful at an arcade).

Preferably, the low coin sensor 51 is located at an appropriate height such that it will no longer sense coins in a coin channel 24 when there are a small number (e.g., 3-6) of coins remaining in the channel 24. The machine 10 can then avoid selecting channels 24 having a low supply (for example, if one quarter channel is low, a different quarter channel is selected, or two dime channels and one nickel channel are selected). The dispenser also preferably provides an audible or visual alarm indicating that the magazine 23 should be replaced. Since the magazine 23 moves the channels 24 past the low-coin station 50, it is only necessary to provide a single low coin sensor. However, as an additional feature, it is also possible to provide a second low coin detector located approximately halfway up the height of the magazine 23 in order to provide a signal indicating that a receptacle is about half-empty. If the magazine 23 is made from an opaque material, the magazine 23 will include the slots 24*c* in the channels 24 so that the low coin detector can sense the coins. However, if the magazine 23 is made from a transparent plastic material, for example, it is not necessary to include slots 24*c* in the channels 24.

Another advantage of the disclosed construction is that it is easily adaptable to different coin mixes (i.e., to different magazines 23 having different numbers and sizes of slots). One coin dispenser 20 could be used with different magazines 23, including magazines with coins from different countries, simply by programming the coin dispenser 20 with data indicating the different types of coin mixes (including data on the coin denomination and the number of coins dispensed with one actuation of the coin ejector 80—usually one or two coins at a time) contained in the different magazines.

This has been a description of preferred embodiments of the invention. Those of ordinary skill in the art will recognize that modifications might be made while still coming within the scope and spirit of the present invention.

For example, although optical sensors are disclosed for the preferred embodiment, sonic sensors or proximity sensors might be substituted without departing from the scope of the broadest aspects of the invention. As another example, while the coin path is preferably circular, looped coin paths of non-circular shape might also be used.

And while tabs are used as the markers for position sensing of the magazine assembly, other types of markers can be used. Therefore, for the scope of the invention, reference is made to the following claims.

We claim:

1. A coin recycling machine for receiving a plurality of coins of at least one denomination, and for queuing the plurality of coins into a single file and then loading at least some of the coins into at least one stack in a coin magazine, wherein the coins are dispensed in a sequence with other denominations from other stacks, the coin recycling machine comprising:

a coin dispenser having a rotatable coin magazine with upstanding channels for holding respective denominations of stacked coins and having an electronic control, said electronic control being operable in response to a commanded total to control a position of said coin magazine to selectively dispense coins to provide the commanded total;

a queuing device for receiving the plurality of coins and arranging the coins in a layer, and in a single file, said queuing device having an exit directed towards said coin magazine and having associated sensors for identifying a denomination of a next coin to pass through the exit; and wherein the electronic control is responsive to the sensors associated with the queuing device for positioning the coin magazine such that coins are sorted into respective channels in the coin magazine by denomination as the coins exit the queuing device.

2. The coin recycling machine of claim 1, wherein the queuing device has a first rotatable disc for assisting in queuing the coins and also has a second rotatable disc with a portion overlying a portion of the first rotatable disc for moving the coins over a stationary member that includes the exit.

3. The coin recycling machine of claim 2, wherein the exit is an aperture in the stationary member.

4. The coin recycling machine of claim 1, wherein the queuing device moves the coins along a path disposed above the coin magazine and disposed substantially parallel to a supporting surface for the coin recycling machine.

5. The coin recycling machine of claim 4, wherein the coin magazine is rotated around an axis of rotation and wherein the coins are moved along a path substantially perpendicular to said axis of rotation.

6. The coin recycling machine of claim 1, wherein the sensors associated with the queuing device further comprise:

a coin denomination sensor for sensing the denomination of each coin as the coin proceeds in the single file in the queuing device; and an exit sensor for sensing each coin as each coin moves through the queuing device to the coin magazine.

7. The coin recycling machine of claim 5, wherein the coin recycling machine further comprises:

at least one coin ejector for ejecting coins from the coin magazine into a coin holder; and at least one position sensor for sensing a position of the coin magazine relative to the coin ejector.

8. The coin recycling machine of claim 1, further comprising a cup for receiving coins that are dispensed from the coin recycling machine.

9. The coin recycling machine of claim 1, wherein the coin magazine has a plurality of coin channels for holding respective denominations of coins and wherein said electronic control is operable in response to the commanded total to be dispensed to control position of said coin magazine to selectively dispense coins from the plurality of coin channels to provide a preselected total amount.

10. A method for receiving, sorting and dispensing coins, comprising: receiving a plurality of coins and arranging the coins in a queue, the queue being directed towards a coin magazine through an individual exit;

identifying a denomination of a next coin to pass through the individual exit; and positioning the coin magazine such that coins are sorted into respective channels in the coin magazine corresponding to respective denominations, wherein the coins are received in a stack in at least one selected channel as the coins exit the queue; and controlling position of the coin magazine to selectively dispense coins from a plurality of stacks corresponding to respective denominations to provide a commanded total.

11. The method of claim 10, wherein the coins are queued by feeding the coins to a first rotating disc, moving the coins on said first rotating disc; restricting movement of the coins at a location on the first rotating disc to a single file of coins and transferring the single file of the coins to a stationary exit member under the control of a second rotatable disc having a portion overlying a portion of the first rotatable disc.

12. The method of claim 11, wherein the moving of the coins along the first rotating disc and the exit member occurs substantially parallel to a supporting surface for the coin dispenser.

13. The method of claim 10, further comprising rotating the coin magazine around an axis of rotation and wherein a moving of the coins occurs along a path substantially perpendicular to said axis of rotation.

14. The method of claim 10, further comprising:

sensing the denomination of each coin as the coin proceeds in a single file in the queue; and sensing each coin as each coin moves through the queue to the coin magazine.

15. The method of claim 10, further comprising:

ejecting coins from the coin magazine into a coin holder; and sensing a position of the coin magazine relative to the coin ejector.

16. The method of claim 10, further comprising receiving coins that are dispensed from the coin dispenser in a coin cup.

17. The method of claim 10, further comprising holding respective denominations of coins in coin channels in the coin magazine and in response to a commanded total, controlling a rotational position of said coin magazine to selectively dispense coins from the plurality of coin channels to provide a preselected total amount.

18. The method of claim 10, wherein levels of coins in the respective channels are sensed, and a user is signaled to feed coins of a selected denomination when a low supply of coins is detected in one of the respective channels.

19. The apparatus of claim 1, further comprising a coin level sensor for detecting a low supply of coins in a respective one of the channels, and wherein the electronic control is responsive to a signal from the coin level sensor to signal a user to feed more coins of a denomination into the to insert the low supply of coins.

* * * * *